US005220739A

United States Patent [19]

Chich et al.

[11] Patent Number: 5,220,739

[45] Date of Patent: Jun. 22, 1993

[54] MERCHANDISE ACCENTUATOR

[75] Inventors: Robert H. Chich, Mequon; David M. Marheine, Wauwatosa, both of Wis.

[73] Assignee: DCI Marketing, Inc., Milwaukee, Wis.

[21] Appl. No.: 711,289

[22] Filed: Jun. 6, 1991

[51] Int. Cl.[5] ..... G09F 13/04

[52] U.S. Cl. ..... 40/564; 40/550

[58] Field of Search ..... 40/541, 550, 564, 574, 40/579, 650; 248/316.7

[56] References Cited

U.S. PATENT DOCUMENTS

| | | | |
|---|---|---|---|
| 3,084,463 | 4/1963 | Guyer et al. | 40/564 |
| 3,086,308 | 4/1963 | Ternouth | 40/541 |
| 3,248,494 | 4/1966 | Barnes | 40/541 X |
| 4,271,408 | 6/1981 | Teshima et al. | 40/564 X |
| 4,640,033 | 2/1987 | Bulger | 40/564 X |
| 4,967,317 | 10/1990 | Plumly | 40/579 X |

FOREIGN PATENT DOCUMENTS

| | | | |
|---|---|---|---|
| 209269 | 1/1987 | European Pat. Off. | 40/550 |

*Primary Examiner*—Kenneth J. Dorner
*Assistant Examiner*—J. Bonifanti
*Attorney, Agent, or Firm*—Foley & Lardner

[57] ABSTRACT

A merchandise accentuator for a store shelf having a molding along the forward edge thereof, the molding forming a channel strip of uniform cross-section having flanges laterally bounding a web portion and providing mutually opposed grooves forwardly of the web portion, the accentuator including a board having a circuit on one side for electrically developing display drive signals, a display mounted on said one side of said board and being operatively connected to said circuit for providing a visual representation corresponding to said drive signals, an independent voltage source mounted on the other side of said board and being operatively connected to the circuit, the accentuator being mounted in the board in the channel in the molding.

5 Claims, 4 Drawing Sheets

MERCHANDISE ACCENTUATOR

FIELD OF THE INVENTION

The present invention relates generally to merchandizing techniques and, in particular, to selling techniques used to accentuate products displayed in self-service operations. More specifically, the invention relates to a merchandise accentuator which is especially well-suited for use in the price channel of merchandise shelves, such as in supermarkets.

BACKGROUND OF THE INVENTION

Supermarkets and other large, high volume discount stores have become commonplace in modern marketing. In such operations, some traditional functions of the sellers are transferred to the buyers, as in the case of self-service. The success of early supermarkets has led to the adoption of self-service techniques in all large scale food retailing in the United States, and also, but much less extensively, in hardware, variety and drug stores, in some department stores and wholesale operations. While the success of such operations seemed initially attributable to price savings due to operating economies of large retailers, customers, however, like the large assortments these stores offer and the opportunity for inspecting and selecting merchandise without the attentions of salesclerks.

Self-service and self-selection have played a large part in a general reorganization of merchandise within a retail store, including the creation of open display fixtures and shelving that allow the customer to inspect and handle the merchandise. Such open and exposed merchandizing has, however, created, in many large stores, a merchandizing monotony, i.e., numerous long and indistinguishable aisles of shelves overwhelmingly packed with items.

Recently, supermarket shelving policies have contributed to even greater shelf congestion. Many supermarkets now limit the amount of shelf space which they will allocate to certain products, resulting in the battle of feet and inches for shelf space among manufacturers and distributors.

In such an environment, research on consumer buying habits has emphasized the importance of visual impact. An item must be seen if it is to be sold, but seeing is itself a matter of degree, for example, of the intensity of the impression created by a display, and the ability of the customer to identify and separate adjacent displays.

Several techniques have been suggested and used to control the customer's reactions throughout the store and to enhance the appeal of certain products over others. For example, one development has been the increased growth of well-advertised manufacturers' brands, which the consumer will accept upon sight.

Lighting has also become an integral part of merchandizing. General lighting intensities in stores are five or six times greater than lights of a few decades ago. Special lighting techniques are used to emphasize and distinguish certain products over others. Spot lighting of product displays is one technique. Back illumination, i.e., a light source behind a translucent or transparent sign or display, has also been popular, but back illumination usually requires bulky units, not suitable for use in simple shelf displays. Some back illumination techniques have, however, been described for shelves. U.S. Pat. No. 3,248,494, issued Apr. 26, 1966, to Barnes and U.S. Pat. No. 3,086,308, issued Apr. 23, 1963, to Ternouth disclose shelf edge signs for product name and price using back illumination. Various shelf edge lights are also commercially available, such as Shelf Lites TM available from Advertising Technologies, Inc., Philadelphia, Pa. These devices require separate, external wiring to electrical sources, separate containers for electrical sources if batteries are used, or structural modification of the conventional molding channel to mount the lighting fixture and provide electrical connection. There remains a need for simple methods for punctuating and dramatizing a product display against the greatly increased general brightness and voluminous open shelving of establishments.

SUMMARY OF THE PRESENT INVENTION

The present invention provides a merchandise accentuator which permits controlled emphasis on particular shelving displays. The accentuator provides effective lighting contrast, perspective and color for product items, and is particularly useful for items which are displayed on conventional supermarket shelving.

In one of its aspects, the invention is a merchandise accentuator which includes electronic circuitry for energizing a display of high intensity-low voltage lamps, both of which are supported on a board. The board also includes connectors for electrically connecting a DC voltage source to the circuit. The connectors, together with the board, form a holder for the voltage source.

In a preferred form, the merchandise accentuator in accordance with the present invention includes, in a unitary structure, an electric circuit which develops display drive signals, and a display, responsive to the display drive signals, for visually representing these signals, both of which are supported on a board. The connectors are supported on one face of the board, while the display is supported on an opposite face. The display suitably includes a plurality of light emitting diodes. The diodes can be energized in any preselected pattern of lighting, depending upon the desired circuitry.

In an illustrated embodiment, the unitary structure is dimensioned and configured to fit within the conventional price channel of, for example, a supermarket merchandise shelf.

The accentuator of the present invention focuses lighting, and hence customer attention, on particular merchandise items. The accentuator is electrically self-contained, requiring no external electrical wiring and, depending on the circuit, can display a preselected lighting pattern of the lamps.

The accentuator, incorporating low voltage lamps, is small and unobtrusive. Its size permits ready concealment from the customer of all components except the lamps. The accentuator can be placed in a shelf price channel so as not to be bumped or brushed by the customer, and can be placed at several points to give greatest effect. With the use of AA batteries as the voltage source, the accentuator typically lasts about 30 days and can be reused by simple replacement of the batteries.

In another aspect, the present invention is a method of manufacturing merchandise accentuators which provides substantial production economies, such as in reduced cost of assembly, and thus reduced unit price. The method in accordance with the present invention includes assembling the accentuators in groups of ten or more from a board which is machined with slots to form breakaway sections, each section corresponding to one accentuator. Manufacture of the grouped accentuators includes resistance patterning of the board, machining the board with slots to form breakaway sections, and with holes to receive the electrical components and lamps, inserting the components and lamps into the board, and wave soldering the wiring pattern. Automatic wave soldering of the wiring pattern for the circuit supported on the board is more efficient and less costly than manual soldering of the individual accentuators. In addition, the time needed for insertion of electrical components and lamps into the breakaway sections of the board is also improved for group manufacture, whether insertion is done by machine or manually.

Other principal features and advantages of the invention will become apparent to those skilled in the art upon review of the following drawings, the detailed description and the appended claims.

DETAILED DESCRIPTION OF THE DRAWINGS

The preferred exemplary embodiment of the present invention will hereinafter be described in conjunction with the appended drawing wherein like designations refer to like elements throughout and in which.

Figure 1:
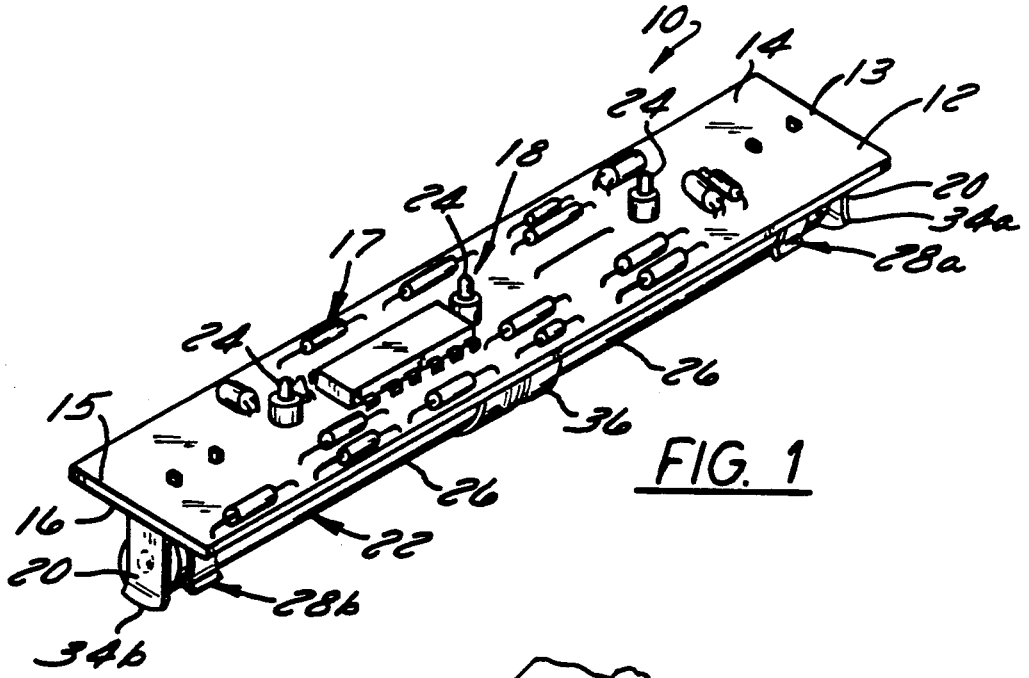
FIG. 1 is a perspective view of a merchandise accentuator in accordance with the present invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

The present invention relates broadly to merchandizing techniques, especially to selling techniques for highlighting products shelved or otherwise displayed in self-service operations. The present invention provides a merchandise accentuator which is particularly well adapted for lighting emphasis of products in merchandise shelving of, for example, retail establishments. Accordingly, in the description of the preferred embodiments of the invention, the merchandise accentuator applied to a shelf edge is used as an example, but it should be appreciated at the outset that the principles of the present invention have a much wider application, that is, in any context in which accentuation of an item, a surface or a shape is desired using illumination.

In accordance with the present invention, products shelved for sale are highlighted by a merchandise accentuator which is positioned in the pricing strip of the merchandizing shelves. The merchandise accentuator of the present invention is characterized by several attributes: it is simple, compact, long-lasting, reusable and requires no external electrical wiring. These attributes are achieved through a particular structural arrangement meeting a special combination of physical parameters.

Figure 3:
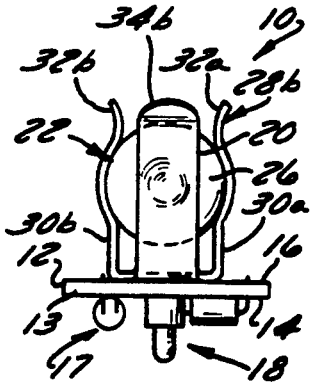
FIG. 3 is an end elevational view of the merchandise accentuator shown in FIG. 1.
Figure 2:
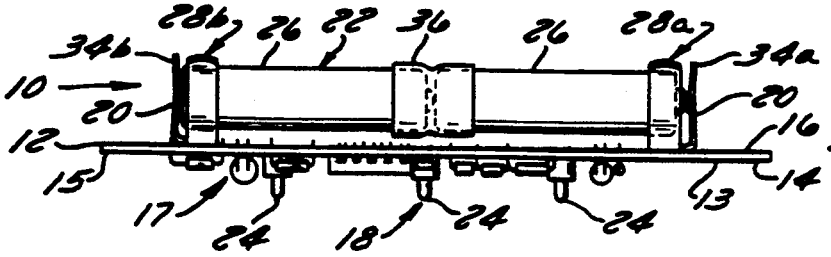
FIG. 2 is a side view of the merchandise accentuator shown in FIG. 1.

Reference is initially made to FIGS. 1, 2 and 3 depicting a merchandise accentuator 10 according to the present invention. The accentuator 10 has an unitary structure which includes a board 12 of the type typically used for supporting a circuit and is suitably made of a fiber glass material. The board 12 has a front side 14 and a back side 16, a display generally designated as 18, supported on the front side 14 of board 12, electric circuitry generally designated as 17 for illuminating the display 18, and connectors generally designated as 20 for holding a DC voltage source 22 on back side 16 of the board 12. The DC voltage source 22, is typically one or more batteries, for example, two conventional size AA batteries 26 or their equivalent.

Display 18 suitably includes one or more low voltage lamps, preferably, high intensity light emitting diodes (LEDs) 24. In the illustrated embodiment, display 18 includes an array of, for example, three LEDs arranged linearly with respect to each other, although any number or arrangement may be used.

Connectors 20 are disposed on the ends 13 and 15 of board 12 and each includes a pair of clips **28*a* and 28*b*, each of which has a bottom 30*a* and 30*b*, arcuate tabs 32*a* and 32*b*, and contact tabs 34*a* and 34*b*, respectively. Clips 28*a* and 28*b* are secured by their bottoms 30*a* and 30*b* to back side 16 of board 12, clip 28*a* at end 13 of back 16 and clip 28*b* at end 15**.

Clips **28*a* and 28*b* along with board 12 form a battery holder. One of batteries 26 is secured in clip 28*a* while the other is secured in clip 28*b*. The batteries 26 are positioned linearly with respect to each along the backside 16 of the board 12. Contact tabs 34*a* and 34*b*, made of a conductive material such as a metal, connect the negative terminal of one battery and the positive terminal of the other to the circuit 17. Arcuate tabs 32*a* and 32*b* are spaced apart and configured in an arc to hold each battery snugly against board 12**.

Batteries 26 are electrically connected in series, with the positive end of one in contact with the negative end of the other. The batteries are suitably held in contact with each other by hot melting a polymeric strip 36 about the contacting ends of the batteries.

In the illustrated embodiment, to form the support or holder for two AA batteries, the circuit board 12 is suitably about $\frac{3}{4}$ inches by $4\frac{1}{4}$ inches. Clips **28*a* and 28*b*** are suitably constructed of a metal or any other material which can provide the arcuate tension to hold the batteries.

Circuitry 17 develops display drive signals for energizing the LEDs 24 from electrical current of voltage source 22. Current flow is produced at each LED as the LED is energized to illuminate. The pattern of energizing of the LEDs may be preselected to be flashing, sequential or random, or continuous, depending on the particular circuitry.

Figure 4:
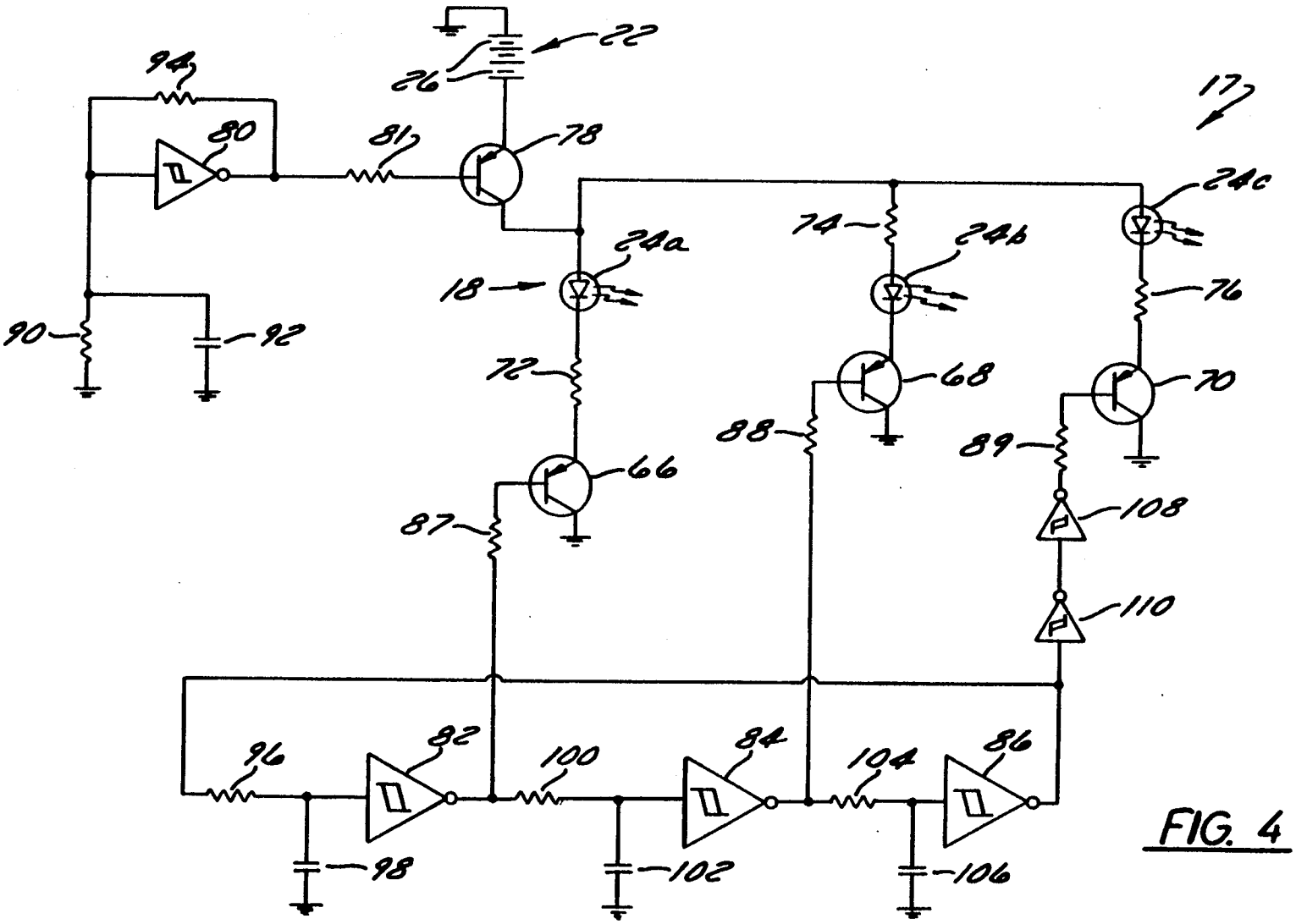
FIG. 4 is a schematic diagram of an electrical circuit for the merchandise accentuator according to the present invention.

Referring now to FIG. 4, a schematic diagram is depicted for a circuit capable of providing a flashing display for the LEDs. In general, the circuit shown operates to illuminate LEDs 24*a*, 24*b* and 24*c* in a random fashion. The circuit shown is merely exemplary and those skilled in the art will recognize that flashing displays may easily be created using either a circuit similar to the one shown but having different component values, or a circuit completely different than the one shown.

The circuit 17 includes a plurality of LEDs 24*a*, 24*b* and 24*c*; a plurality of transistors 66, 68, 70 and 78, resistors 72, 74, 76, 81, 87, 88, 89, 90, 94, 96, 100 and 104; Schmitt triggers 80, 82, 84 and 86; and a plurality of capacitors 92, 98, 102 and 106.

The circuit 17 provides a flashing display by enabling and disabling a current path through each of LEDs. Specifically, each of the respective LEDs 24*a*, 24*b* and 24*c* is connected in series with one of the respective transistors 66, 68 and 70 and one of respective current limiting resistors 72, 74 and 76. Thus, LED 24*a* is connected in series with resistor 72 and transistor 66; LED 24*b* is connected in series with transistor 68 and resistor 74; and LED 24*c* is connected in series with transistor 70 and resistor 76.

Each LED-transistor-resistor series is further connected in series with transistor 78 and a +3 volt power supply 22. When one of the transistors 66, 68 and 70 is ON and transistor 78 is ON, a current path is formed from the voltage source through the LED and resistor in series with the ON transistor, and the LED is illuminated.

Schmitt triggers 80, 82, 84 and 86 are connected in a conventional manner, with an RC input circuit and a feedback path, which includes input resistors 90, 96, 100 and 104 and capacitors 92, 98, 102 and 106. The output of each of respective Schmitt triggers 80, 82, 84 and 86 is connected through one of the respective current limiting resistors 87, 88 and 89 to the base of one of the respective transistors 66, 68, 70 and 78.

Schmitt triggers 80, 82, 84 and 86 provide random pulses which turn ON and OFF transistors 66, 68, 70 and 78, thereby causing LEDs 24*a*, 24*b* and 24*c* to be illuminated or not illuminated. Each of the Schmitt triggers 80, 82, 84 and 86 is an inverter with hysteresis in the input switching points, i.e., the output goes HIGH when the input voltage falls below a first level, and the output goes LOW when the input voltage rises above a second level. Thus, when the output of one of the respective Schmitt triggers 80, 82, 84 and 86 is HIGH, the associated transistor is ON.

The timing of each of the Schmitt triggers 80, 82, 84 and 86 is controlled by the RC input circuit, 90, 92, and the feedback path through resistor 94. Schmitt trigger 80 has an output feedback in which the output oscillates between HIGH and LOW dependent on the RC time constant of the input circuit (resistor 90 and capacitor 92) and feedback resistor 94. Each of the Schmitt triggers 82, 84 and 86 have a feedback path which includes the other two of the Schmitt triggers 82, 84 and 86. The output of each will oscillate between HIGH and LOW dependent on the respective input circuit and the output state of the other Schmitt triggers. This arrangement creates a pulse sequence that causes LEDs 24*a*, 24*b* and 24*c* to blink on and off in a random manner.

In the circuit 17, Schmitt triggers 80, 82, 84 and 86 and 108 and 110 are part of an integrated circuit hex Schmitt trigger such as MM74C14 available from National Semi-Conductor. Schmitt triggers 108 and 110 are simply cascaded inverters and are only used to facilitate the lay-out of the circuit on a printed circuit board. The pin numbers for the MM74C14 are shown as P1–P13. Circuit values for other components are as follows and are illustrative of the particular embodiment: current limiting resistors 72, 74 and 76 are suitably 100 ohms; current limiting resistors 87, 88 and 89 are suitably 22K ohms; current limiting resistor 81 is suitably 18K ohms; input circuit resistors 96, 100 and 104 are suitably 1M ohm; input resistor 90 is suitably 10M ohms; feedback resistor 94 is suitably 1M ohm; and capacitors 92, 98, 102 and 106 are suitably 0.1 farads.

To fabricate the accentuator according to the present invention, components such as capacitors and resistors, and the desired number of light emitting diodes can be manually inserted in a desired arrangement into an appropriately sized board and then manually soldered to be electrically coupled to a preselected circuit capable of developing a particular lighting pattern in the light emitting diodes.

However, a method of fabrication has been developed which has certain production economies. The boards supporting the desired circuit can be made in groups of ten or more from a larger presectioned board which is broken apart to form the individual merchandise accentuators in accordance with the present invention. Use of such a larger board permits automatic wave soldering, which allows a very low component profile and provides substantial reductions in the cost of assembly and unit price of the accentuator.

Figure 5:
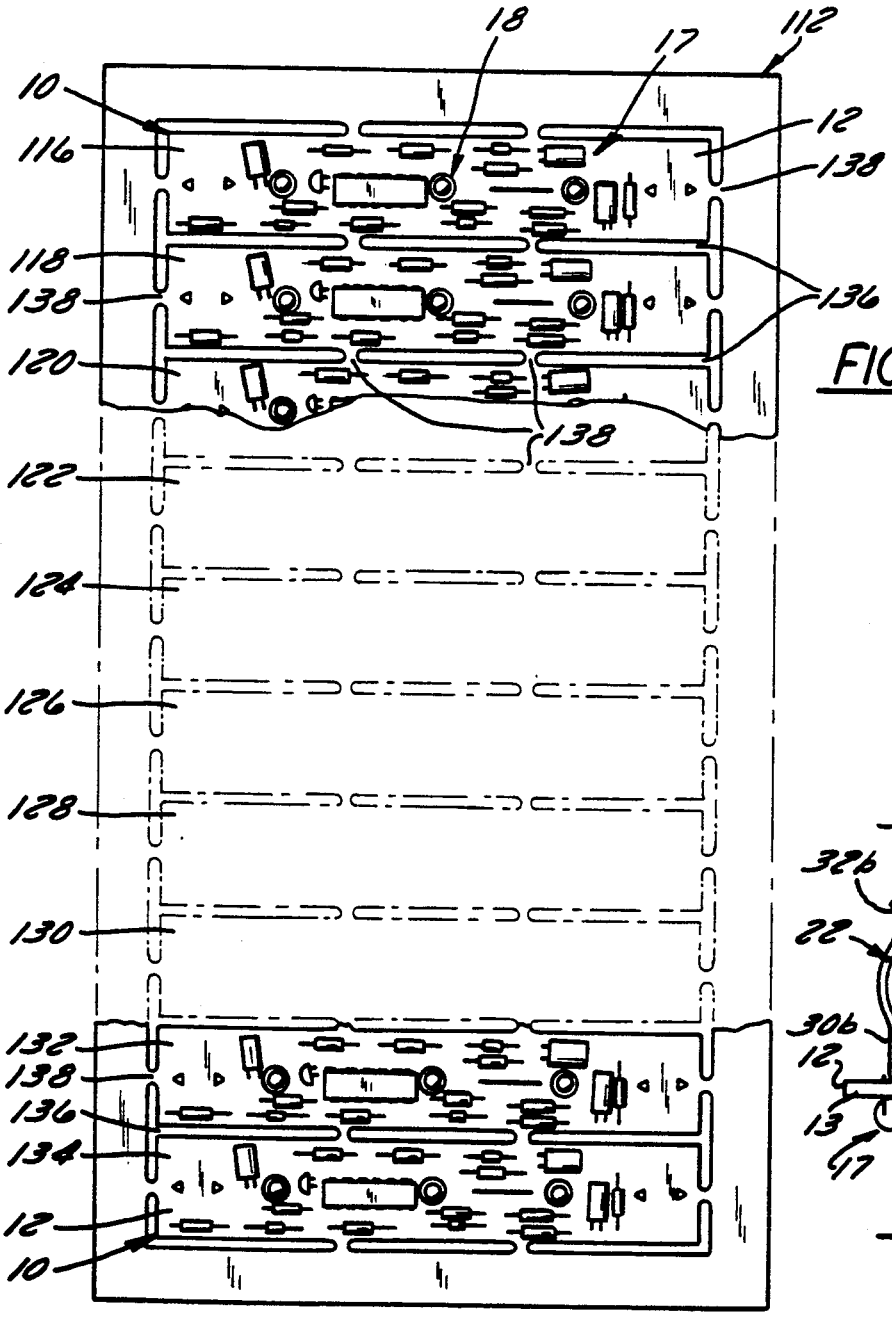
FIG. 5 is a top plan view of a presectioned circuit board with components used in the manufacture of the merchandise accentuator of the present invention.
Figure 6:
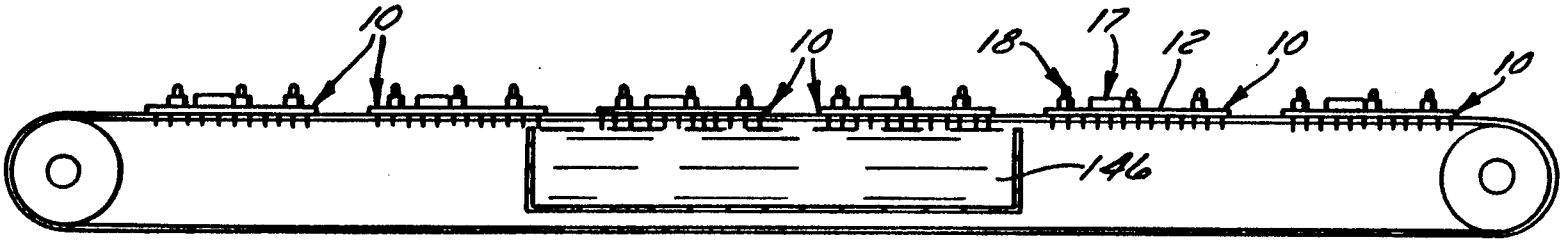
FIG. 6 is a side view illustrating the wave soldering technique used in the manufacture of the presectioned board shown in FIG. 5.

FIGS. 5 and 6 illustrate the method of fabricating the accentuators 10. A large board 112 suitable for supporting a circuit, and typically constructed on fiber glass, is dimensioned to ultimately produce ten (or more) individual accentuators of preselected size. The surface of the board 112 which is the soldering surface is then masked and etched using resistance techniques well established in circuit manufacturing technology. The board 112 is then machined into sections 116, 118, 120, 122, 124, 126, 128, 130, 132 and 134 by forming slots 136 in the board 112 with adjoining board portions 138 holding the sections in the board. The board is also machined with holes for insertion of components. Components and connectors, including LEDs 24*a*, 24*b* and 24*c*, are inserted into each of the sections in the board 112, either manually or by machine. As seen in FIG. 6, the board 112 is then passed over a reservoir 146 of soldering compound. Only the exposed metallic tips of the inserted components and LEDs, and the etched pattern pick up the solder and are electrically coupled to complete the preselected circuit for developing the lighting pattern for the LEDs. Each individual section of the perforated board, when broken apart, forms a merchandise accentuator in accordance with the present invention.

Figure 7:
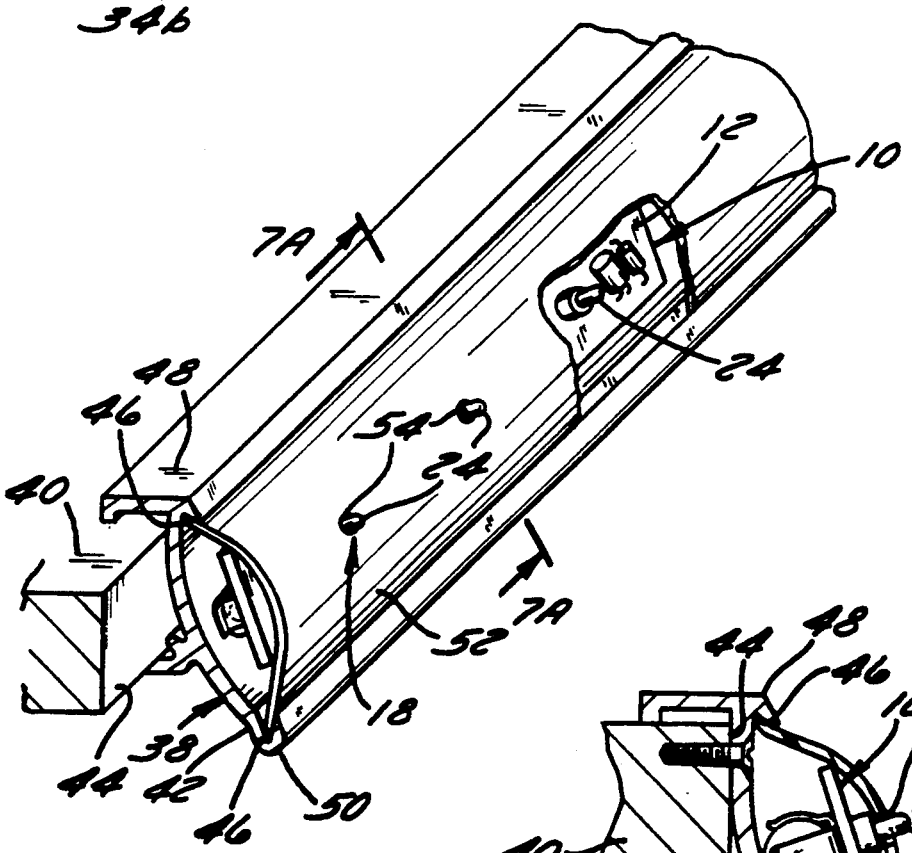
FIG. 7 is a perspective view, with parts broken away, of a merchandise shelf price channel with the merchandise accentuator of the present invention positioned in the channel.
Figure 7A:
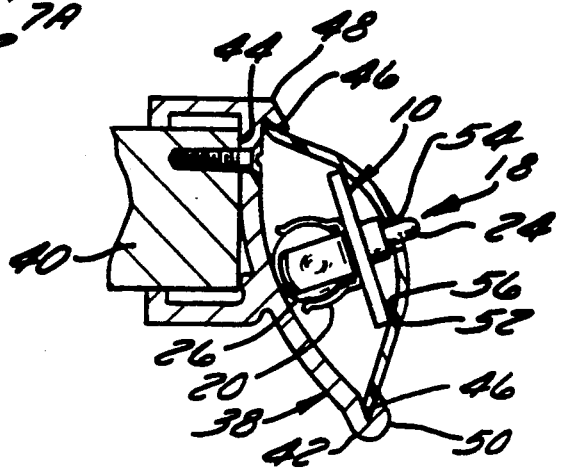
FIG. 7A is a cross-section taken on line 7A—7A of FIG. 7.

Referring now to FIGS. 7 and 7A, in accordance with one aspect of the invention, merchandise accentuator 10 is illustrated positioned in a price channel 38 of a conventional merchandise shelf 40. Price channel 38 is an elongate strip 42 which is attached to the shelf edge 44 of a merchandise shelf 40. Price channel 38 includes a pair of longitudinal grooves 46 which extend along the top 48 and bottom 50. A cover 52 is a flexed, concave plastic strip which fits within the grooves 46. The cover 52 has apertures 54 through which LEDs 24 extend to be visible. Merchandise accentuator 10 may include an adhesive strip 56 secured to the top to secure accentuator 10 to the undersurface of cover 52 and maintain a fixed position in the channel 38.

Figure 9:
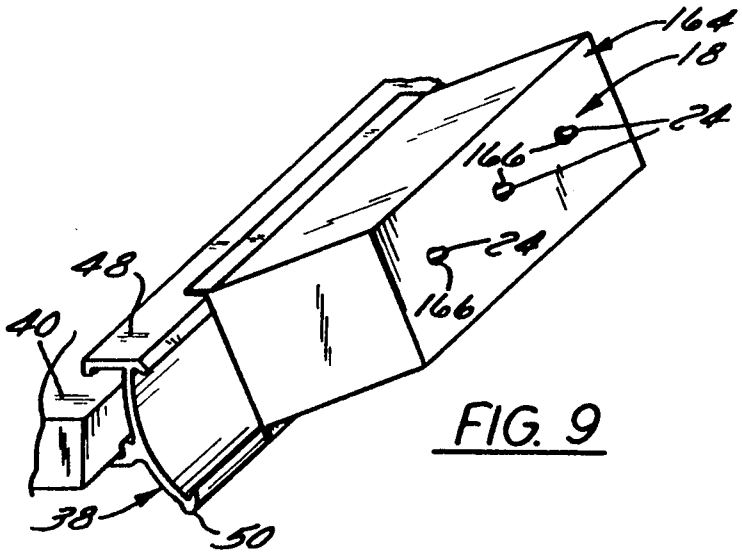
FIG. 9 is a perspective view of the accentuator with a cover.
Figure 8:
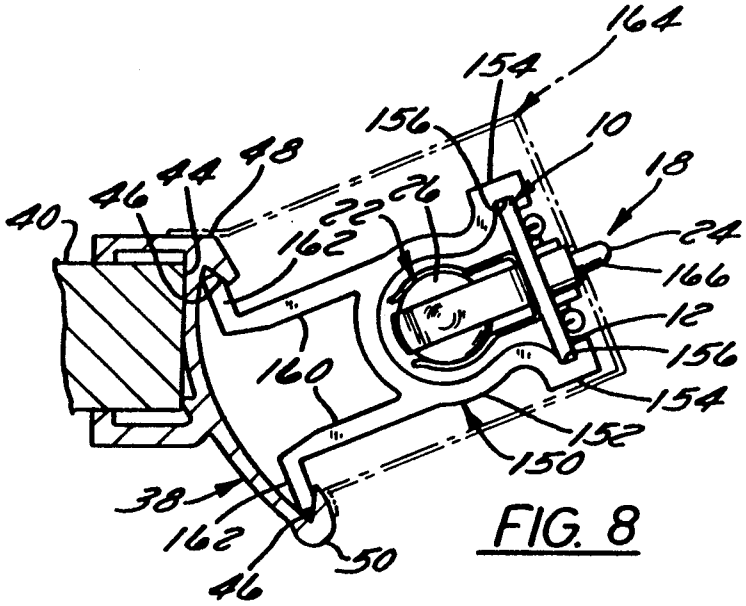
FIG. 8 is an end view of an alternative embodiment of the merchandise accentuator with an attached shelf edge clip.

Referring now to FIG. 8, in another embodiment, a holder 150 is provided for attaching the accentuator 10 to the price channel 38 of shelf 40. Holder 150 includes a circular section 152 which is configured and dimensioned to hold batteries 26. A pair of oppositely disposed side walls 154 having an end groove 156 are dimensioned and configured to engage the sides of board 12. Holder 150 also includes a pair of parallel elongate sides 160 having outwardly extending flanges 162 at the outer end. Flanges 162 are inserted into the grooves 46 in channel 38 for supporting the accentuator in a spaced relation to the shelf. As seen in FIG. 9, accentuator 10 includes a cover 164 operatively connected to board 12. Cover 164 has apertures 166 through which LEDS 24 of display 18 protrude.

In summary, the present invention provides a merchandise accentuator which is simple, compact, has no separate battery holder or external hard wiring, can accommodate a virtually limitless arrangement and number of LEDs. The invention also provides a method of fabrication of the accentuator which has production economies such that the accentuators are a relatively low cost selling technique.

Thus, it should be apparent that there has been provided in accordance with the present invention a merchandise accentuator that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A merchandise accentuator adapted to be mounted on a price channel mounted on the edge of a shelf, said accentuator, comprising a unitary structure including a board and a pair of clips supported on said board, said board and clips together configured for holding a DC voltage source;

a circuit supported on said board for electrically developing display drive signals;

a number of light emitting diodes responsive to the display drive signals for providing a visual representation corresponding to the display drive signals;

conductors supported on said board for electrically connecting the voltage source to said circuit; and a cover mounted on the price channel, said cover including a number of apertures with said light emitting diodes protruding through said apertures.

2. The accentuator of claim 1, wherein said board has a pair of opposed faces, and said display is disposed on one of said pair of faces, and said clips and said conductors are disposed on the other of said pair of faces.

3. A merchandise accentuator, comprising a unitary structure configured and dimensioned to fit a price channel mounted on the edge of a shelf, including:

circuit means for electrically developing display drive signals, said circuit means being supported on a board having a pair of opposed faces;

connector means disposed on one of said faces, a battery supported on said board by said connector means, electrically connecting said source to said circuit means;

display means mounted on said board and being responsive to said display drive signals for providing a visual display corresponding to said display drive signals, said display means including at least one light emitting diode disposed on said other of said faces of said board; and means for supporting the accentuator in a spaced relation to the shelf, said supporting means including a holder having a circular section for enclosing said battery, a pair of side walls having grooves for engaging said board and a pair of sides having flanges at the outer end for engaging said price channel.

4. The accentuator according to claim 3 wherein said connector means includes a pair of clips mounted on said board, said voltage source includes one or more batteries supported on said board by said clips and said electrical connecting means including a pair of conductive tabs positioned to connect the ends of said batteries to said circuit means.

5. A merchandise accentuator for a price channel mounted on the front edge of a shelf, said accentuator comprising a unitary structure configured and dimensioned to fit within the price channel including (a) circuit means for electrically developing display drive signals, said circuit means including a circuit board having a pair of side faces; (b) connector means, mounted on one of said side faces, for holding and electrically connecting a DC voltage source to said circuit means; (c) display means, responsive to said display drive signals, for visually representing said signals, said display means including a plurality of light emitting diodes mounted on said other of said side faces of said board; and (d) a cover mounted on the price channel to enclose said unitary structure, said cover engaging the edges of said board and further including apertures aligned with said light emitting diodes.

* * * * *